United States Patent [19]

Moore

[11] 4,007,549

[45] Feb. 15, 1977

[54] SOLE FOR ATHLETIC SHOE

[76] Inventor: Robert J. Moore, 3533 Ridgewood Drive, Pittsburgh, Pa. 15235

[22] Filed: June 3, 1975

[21] Appl. No.: 583,300

[52] U.S. Cl. ..... 36/59 C; 36/129

[51] Int. Cl.[2] ..... A43B 5/00; A43B 23/28

[58] Field of Search ..... 36/2.5 R, 59 R, 59 B, 36/59 C, 25 R, 2.5 AG, 30 R, 31

[56] References Cited

UNITED STATES PATENTS

| | | | |
|---|---|---|---|
| 2,369,531 | 2/1945 | Caltabiano | 36/31 |
| 2,478,664 | 8/1949 | Morrow et al. | 36/31 |
| 3,543,420 | 12/1970 | Dassler | 36/59 C |
| 3,552,040 | 1/1970 | Welco et al. | 36/30 R |

*Primary Examiner*—Patrick D. Lawson
*Attorney, Agent, or Firm*—Staas & Halsey

[57] ABSTRACT

An improved sole for an athletic shoe comprises artificial turf material such as is commercially available and having a flexible backing from which the artificial turf projects in a common direction. Preferably, the turf is cut into the shape of the sole of a shoe in three sections and is adhered to an inner sole of the shoe by an adhesive so as to form a sole of substantially continuous artificial turf material. The sole is of suitable configuration for use with desired types of athletic shoes and may include baseball, soccer, football, tennis, and the like type of athletic shoes. The shoe is of substantially reduced weight relative to conventional such shoes yet affords greatly improved gripping, whether on natural or artificial turf, with avoidance of ankle and spiking injuries typically encountered with athletic shoes employing spikes and the like.

7 Claims, 11 Drawing Figures

SOLE FOR ATHLETIC SHOE

BACKGROUND OF THE INVENTION

This invention relates to athletic shoes and, more particularly, to an improved sole construction for athletic shoes.

STATE OF THE PRIOR ART

As is well-known in the prior art, it is important to provide a high traction sole on athletic shoes to provide adequate gripping of the shoe on a playing surface. In the prior art, spikes, cleats, and other such protruding elements have been mounted on the sole of an athletic shoe to provide necessary traction on a playing surface.

The advent of artificial turf has introduced problems in this area, in that the prior art spiked shoe has not afforded adequate traction and indeed has been generally unacceptable for use on artificial turf. Numerous different sole designs have been developed to render athletic shoes more compatible with artificial turf surfaces. Generally, these new designs, while in use today, have not been successful in affording adequate traction on artificial turf. As is well-known, the frequency of injuries to athletes playing on artificial turf surfaces has increased and is a matter of great concern.

Accordingly, there exists in the art a need for a sole of a construction which is highly compatible with artificial turf playing surfaces and which affords the necessary traction on such surfaces. It is desirable, moreover, that the sole be compatible with natural turf surfaces as well to afford versatility in the use of the athletic shoe. Prior art constructions do not afford this versatility and instead special designs are required for use separately on natural vs. artificial turf playing surfaces.

Prior art athletic shoes, moreover, are typically of rather heavy construction, especially where cleats and the like are required, and moreover, are expensive in manufacture due to the structural support necessary for mounting the cleats.

It, therefore, is an object of this invention to provide an improved sole for an athletic shoe which is low in cost of manufacture yet provides improved surface traction, whether on natural or artificial turf.

It is a further object of this invention to provide an improved sole for an athletic shoe which is of a commercially available material and may be readily cut to shape to the desired shoe sole size and configuration.

Still another object of this invention is to provide an improved athletic shoe having a sole of artificial turf material.

Yet another object of this invention is to provide an athletic shoe having an improved sole surface which is low in cost of construction yet which provides improved traction on either natural or artificial turf.

These and other objects of this invention will be more apparent from the following detailed description of the invention.

DETAILED DESCRIPTION OF THE PREFERRED EMBODIMENTS OF THE INVENTION

Figure 1:
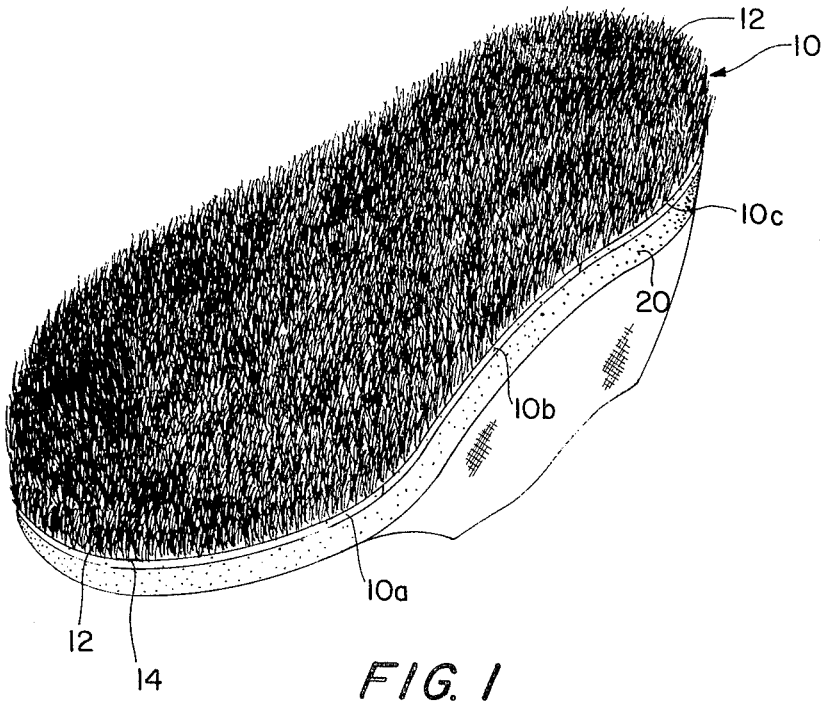
FIG. 1 is a perspective bottom view of an athletic shoe having an improved sole comprising artificial turf as the gripping surface of the sole.
Figure 2:
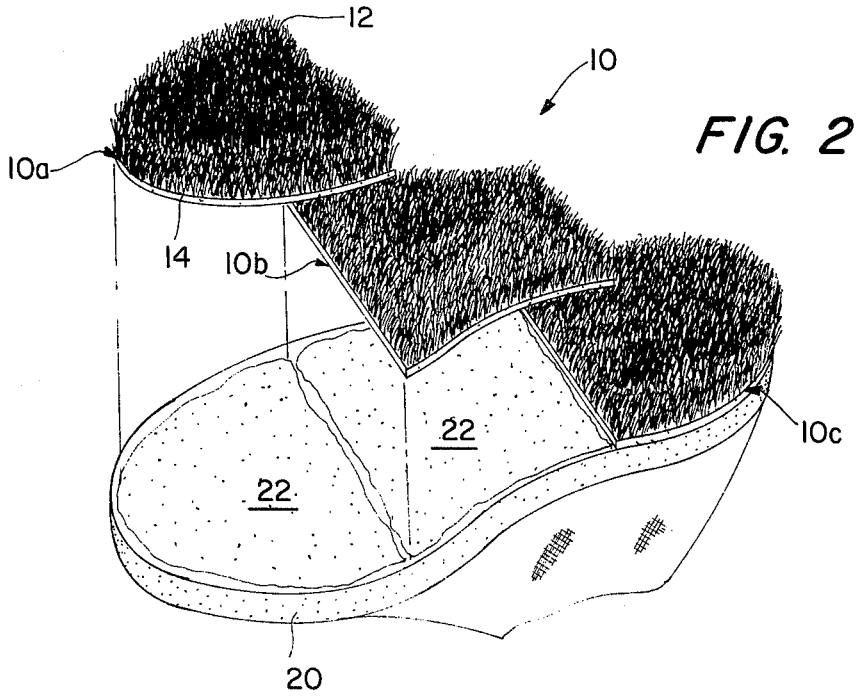
FIG. 2 is an exploded perspective view of the sole of FIG. 1, for illustrating structural features of the sole for assembly with shoe uppers.

With concurrent reference to FIGS. 1 and 2, the improved sole for an athletic shoe, in accordance with the invention, includes a synthetic or artificial turf sole 10 including outwardly extending fibrous material 12 and a backing layer 14. The layer 14, generally, must be of sufficient flexibility for the purpose here intended. Preferably, the sole 10 is formed in three sections 10*a*, 10*b*, and 10*c*, as seen in FIG. 2. The separate sections, however, abut one another closely and the juncture line thereof is generally not noticeable in the completed structure, although it is visible in FIG. 1. The turf 12, on the other hand, appears uniform throughout.

Figure 3:
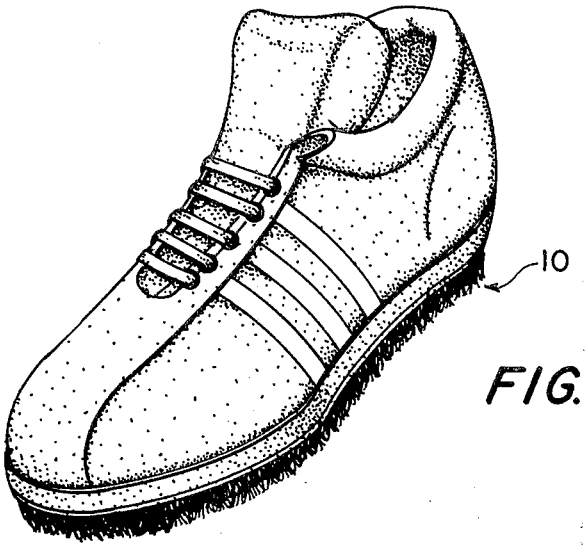
FIG. 3 is a perspective view of an athletic shoe of a conventional baseball or soccer type employing the improved sole of the present invention.
Figure 4:
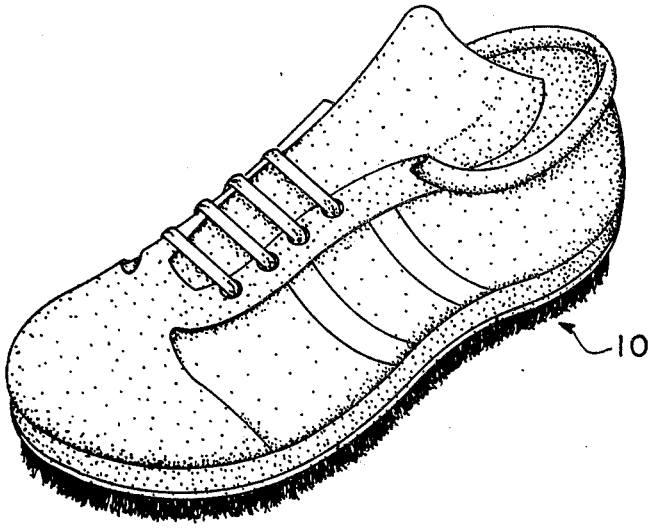
FIG. 4 is a perspective view of an athletic shoe of a conventional football type employing the improved sole of the present invention.
Figure 5:
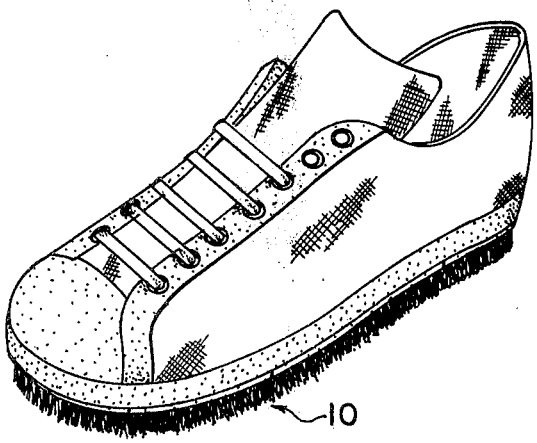
FIG. 5 is a perspective view of an athletic shoe of a conventional tennis shoe type employing the improved sole of the present invention.

It is to be understood that the sole of this invention may be employed with any type of athletic shoe. Accordingly, FIGS. 3, 4 and 5 show perspective views of different types of athletic shoes which may utilize the improved sole of the invention. FIG. 4 particularly is a perspective view of an athletic shoe having uppers of a conventional baseball or soccer type configuration. FIG. 5 is a perspective view of an improved athletic shoe in accordance with the invention wherein the uppers are of the type employed for football. FIG. 6 is a perspective view of an improved shoe wherein the uppers are of a tennis shoe type.

Figure 6A:
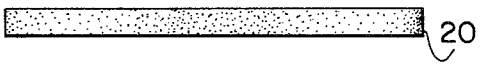
FIGS. 6A through 6E illustrate successive steps in the manufacture of an improved sole in accordance with the invention.
Figure 6B:
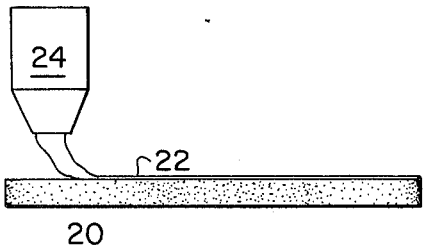
Figure 6C:
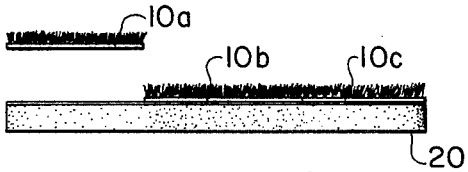
Figure 6D:
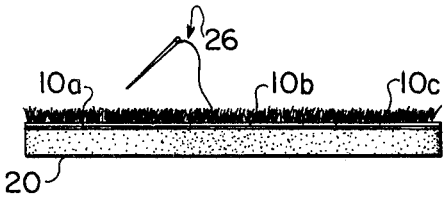

FIGS. 6A through 6E illustrate successive steps in the construction of an improved sole in accordance with this invention. Element 20 comprises the basic, or inner, sole of the shoe as conventionally employed in athletic shoes. For example, this may be a rubber sole of about ¼ inch thickness. FIG. 6B illustrates the application of an adhesive 22, such as a suitable flexible epoxy resin as is commercially available, to the bottom surface of the inner sole 20, from a supply/dispenser 24. FIG. 6C then illustrates the positioning of the three separate sections 10*a*, 10*b*, and 10*c* of the sole 10 on the inner sole 20.

Although the adhesive typically suffices to secure the artificial turf material 10*a*, 10*b* and 10*c* to the inner sole 20, it may well be desirable to reinforce the construction, especially along the shoe perimeter, by stitching as diagrammatically at 26. The stitch line would extend about the entire periphery of the inner sole 20 and if deemed necessary may extend as well along the abutting edges of the sole elements 10*a*, 10*b*, and 10*b* and 10*c*.

Figure 6E:
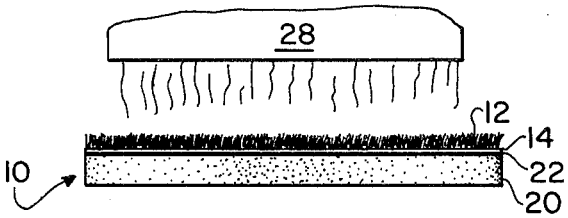

FIG. 6E then illustrates the application of heat from a source 28 to cure the resin 22 and thereby strongly secure the artificial material 10 through its backing element 14 to the inner sole 20.

Figure 7:
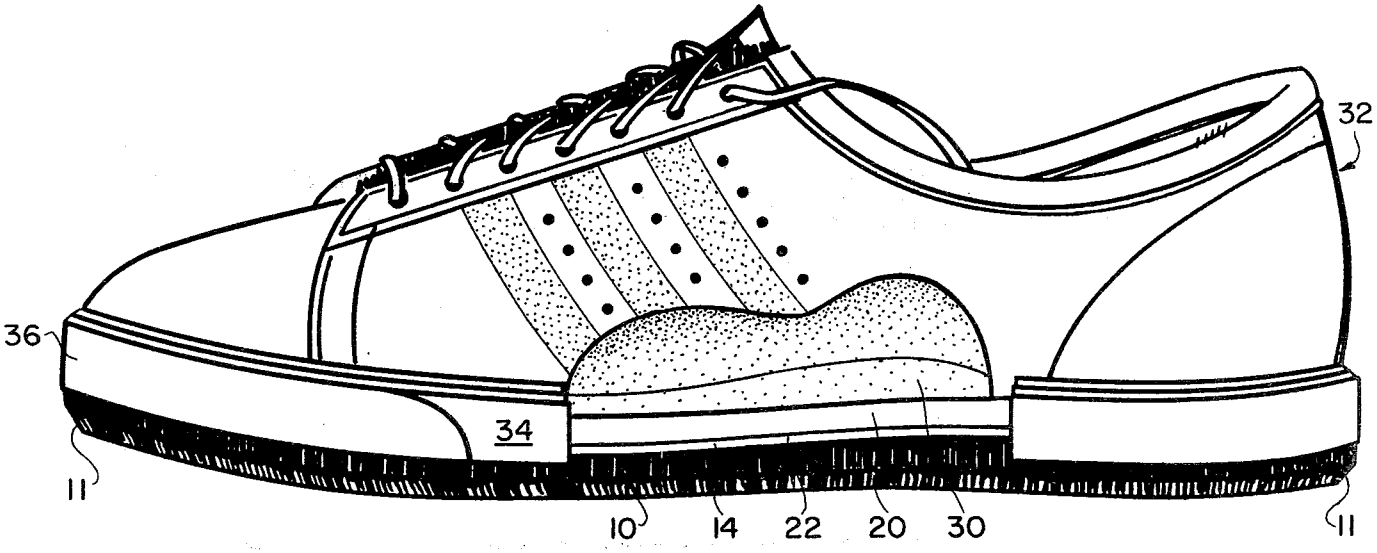
FIG. 7 is a side elevational view, partly in section, of an athletic shoe incorporating the improved sole of this invention.

FIG. 7 is a more detailed side elevational view of an athletic shoe employing the improved sole of the invention and is partly cut away to illustrate the internal shoe construction, which may be of conventional type. In general, the improved sole 10 is joined at its backing 14 by the epoxy layer 22 to the inner sole 20. A cushion insert 30 typically is provided for arch support on the upper surface of the inner sole 20. The uppers of the shoe, generally designated at 32, then are secured to the inner sole 20 in a conventional manner, by heat curing and/or by stitching, as desired. The juncture of the uppers 32, the inner sole 20, and the backing material 14 of the improved sole 10 is overlapped by a strip element 34 which may be of rubber material and serves both to secure the juncture and provide improved appearance. Further, a conventional toe guard 36 may be affixed to the perimeter of the shoe adjacent the toe end thereof.

It is desirable to trim the artificial turf along the perimeter of the shoe, as shown at 11, it being understood that the trimmed edge would extend uniformly about the perimeter of the artificial turf sole.

The three piece construction of the artificial turf sole shown at 10*a*, 10*b* and 10*c* is intended to improve the flexibility of the sole and thereby increase the mobility of the foot. The juncture line between sections 10*a* and 10*b* is selected to be at a position of maximum required flexing of the sole, generally adjacent the ball of the foot, and that between 10*b* and 10*c* to be such as to cause section 10*c* generally to correspond to a heel of a shoe. Section 10*b* then corresponds generally to the instep of the shoe. Comfort, speed and balance, of course, are important criteria in the design and construction of an athletic shoe. Hence, it will be understood that the three piece construction is not limiting but rather any suitable form of multiple element construction of the artificial turf sole 10 is to be construed as within the scope of this invention.

It will be appreciated that various designs in, or alternate forms of sectioning of the sole 10 may be provided and that the same fall within the scope of the invention. In general, however, it is believed to be preferable to form the sole with a continuous surface of turf, as shown. Further, whereas a uniform thickness and density turf generally is suggested in the above figures, the turf may vary in these aspects. For example, a thicker depth of turf may be employed in the heel region to provide greater foot elevation. More dense turf may be employed in the areas of greatest support and/or wear, such as the heel (section 10*c*) and ball (section 10*a*) areas, and a less dense turf in a section 10*b* to provide greater flexibility to the instep portion of the foot.

Numerous sources of artificial turf material, of course, are available. The selection of the material for use with the shoe principally is to be based upon the backing surface of the turf material having adequate flexibility for the intended use thereof as a sole for an athletic shoe.

Shoes constructed in accordance with the invention exhibit extremely improved qualities as to traction and mobility while being light in weight. The soles are durable and long-lasting, yet low in cost of manufacture. Absence of cleats and the like assures greatly improved safety relative to prior art athletic shoe construction.

Numerous modifications and adaptations of the invention will be apparent to those of skill in the art and hence it is intended by the appended claims to cover all such modifications and adaptations as fall within the true spirit and scope of the invention.

What is claimed is:

1. In an athletic shoe having uppers and an inner sole to which said uppers are joined, an improved traction sole for use on playing fields selectively of natural turf and artificial turf, each said turf defining a surface of said playing field comprising upwardly protruding, randomly oriented, fiber-like elements, comprising:

synthetic turf material of a configuration corresponding to a desired traction sole configuration and having a flexible backing layer and plural resilient fiber-like elements extending substantially individually from one surface of said backing layer in random orientations and of a sufficient length to project individually into and interengage with the randomly oriented fiber-like elements of said turf of said playing field surface for providing improved traction therewith in all directions of movement of the sole on the said playing field turf surface, and a layer of adhesive material intermediate said synthetic turf traction sole and said inner sole for securing the traction sole to said inner sole.

2. The improved traction sole as recited in claim 1 wherein said synthetic turf material comprising said traction sole is provided in a plurality of individual pieces and secured to said inner sole, thereby to afford improved flexibility of said traction sole.

3. An improved traction sole as recited in claim 1 wherein said synthetic turf material is formed in plural sections including at least one section corresponding to the heel of the shoe and a further section extending from about the ball to the toe of the shoe.

4. An improved traction sole as recited in claim 3 wherein said heel section and said further section are formed of a more dense turf material than the turf material forming the remainder of the traction sole.

5. An improved traction sole as recited in claim 1 further including stitching extending at least about the periphery of the traction and inner soles to secure said traction and inner soles together.

6. An improved sole as recited in claim 1 wherein there is further provided a strip of edging material overlying the juncture of the inner and traction soles and extending about the periphery thereof.

7. An improved traction sole as recited in claim 1 wherein said synthetic turf material is trimmed at an angle from the perpendicular to the inner sole about the periphery of the traction sole.

* * * * *